United States Patent [19]

Fricker et al.

[11] 4,283,896

[45] Aug. 18, 1981

[54] TIE ANCHOR FOR SANDWICH PANELS OF REINFORCED CONCRETE

[75] Inventors: Siegfried Fricker, Wurmbergerstrasse 30-34, 7135 Wiernsheim, Fed. Rep. of Germany; Horst Reinkensmeier, Niefern-Öschelbronn, Fed. Rep. of Germany

[73] Assignee: Siegfried Fricker, Wiernsheim, Fed. Rep. of Germany

[21] Appl. No.: 71,373

[22] Filed: Aug. 30, 1979

[30] Foreign Application Priority Data

Nov. 15, 1978 [DE] Fed. Rep. of Germany ..... 2849520

[51] Int. Cl.[3] ..... E04C 2/26; E04B 2/30

[52] U.S. Cl. ..... 52/410; 52/309.11; 52/309.12; 52/712

[58] Field of Search ..... 52/410, 393, 309.11, 52/309.12, 712, 714, 715

[56] References Cited

U.S. PATENT DOCUMENTS

| | | | |
|---|---|---|---|
| 2,476,433 | 7/1949 | Shinn, Jr. | 52/410 X |
| 3,494,088 | 2/1970 | Körner | 52/410 |
| 3,757,482 | 9/1973 | Haeussler | 52/410 X |

FOREIGN PATENT DOCUMENTS

| | | | |
|---|---|---|---|
| 2021192 | 4/1972 | Fed. Rep. of Germany | 52/410 |
| 2023363 | 12/1973 | Fed. Rep. of Germany | 52/410 |
| 2403717 | 7/1975 | Fed. Rep. of Germany | 52/410 |

*Primary Examiner*—Alfred C. Perham
*Attorney, Agent, or Firm*—Joseph A. Geiger

[57] ABSTRACT

Tie anchor for sandwich panels of reinforced concrete in the form of a metal strip of undulated zigzag shape whose loop portions are anchored in the concrete panel layers and whose connecting leg portions reach through the intermediate insulating layer. Two central leg portions of the tie anchor are oppositely inclined to form a rigid central connecting point between the panel layers, while all other leg portions are parallel, to allow for limited panel displacements, under unequal thermal expansion.

4 Claims, 5 Drawing Figures

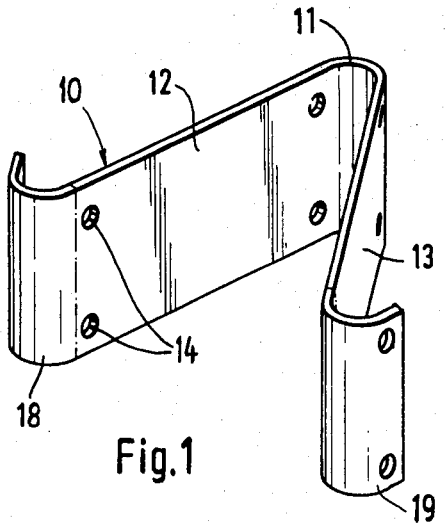
Fig.1
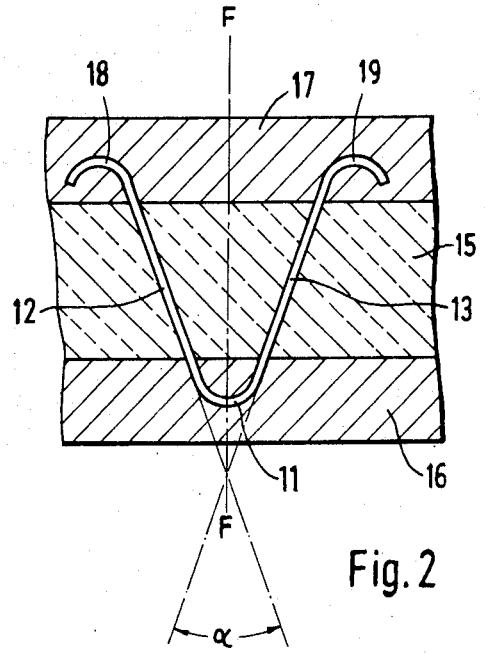
Fig. 2
Fig. 5
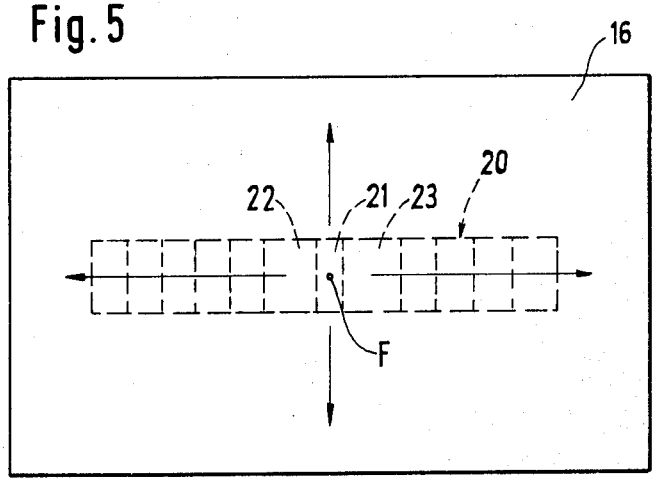

TIE ANCHOR FOR SANDWICH PANELS OF REINFORCED CONCRETE

BACKGROUND OF THE INVENTION

1. Field of the Invention

The present invention relates to anchoring elements for structural building components, and, more particularly to a tie anchor for sandwich panels of reinforced concrete which are used as wall members of a building.

2. Description of the Prior Art

Sandwich panels of the type mentioned above consist generally of two panel layers of reinforced concrete which hold between them an insulating layer of lightweight material, such as mineral wool, foamed concrete, vermiculite, or styrofoam and the like.

The sandwich panel, normally serving as an outside wall member of a building, is supported and fixedly anchored to the building by one of its concrete panal layers, while the other, outer, concrete panel layer and the intermediate insulating layer are attached to the first panel layer so as to be carried by that layer. For this reason, the outer panel layer of the sandwich construction is frequently thinner and lighter than the inner panel layer.

In order to attach and support the outer panel layer on the inner panel layer, it is necessary to use one or several tie members of steel which traverse the intermediate panel layer and have extremities which are anchored in the two concrete layers. It is known, for example, to use for this purpose flat bands or strips of heavy sheet metal which are shaped to have an undulating, or zigzag outline. This tie anchor, accordingly, has top loops and bottom loops which extend into the inner and outer concrete panels, respectively, where reinforcing rods reach through holes in the loop portions. A tie anchor of this type is disclosed in the German Offenlegungsschrift (Publ. Application) No. 24 03 717. The one-piece tie anchor which is disclosed in this publication has a number of undulations which run horizontally between the two concrete panel layers. In order to provide the required supporting function, the metal strip has to be of a width which is approximately equal to, or larger, than the spacing between the top and bottom loops of the anchor.

The aforementioned Published Application also discloses, as an improvement over the one-piece tie anchor, an arrangement of two narrow undulated anchor members which are attached to each other on the loops which are embedded in the outer panel layer and whose opposite loops are spread apart vertically, where they are embedded in the supporting panel layer, thereby forming a V-shaped tie.

Since sandwich panels of the type under consideration undergo different degrees of thermal expansion on their inner and outer concrete layers, it is necessary to provide a limited displaceability of one panel relative to the other. This limited mobility is made possible by the undulations of the above-described tie anchor which, having substantially parallel connecting portions between their top and bottom loops, respond in the manner of parallel links, whereby the material of the intermediate insulating layer is locally compressed or displaced by the small lateral displacements of the tie anchor leg portions.

In a paper entitled "Vorfertigung in der Bautechnik", published in the journal "DIE BAUTECHNIK", Vol. 32, Issue No. 9, Sept. 1955, p. 319 (adapted from an article in "Journal of the American Concrete Institute", Vol. 1954, Issue No. 2, p. 149), is further disclosed an anchoring method for sandwich wall panels which suggests the arrangement of a plurality of shear-resistant, transversely rigid connecting members which likewise have a zigzag outline. The lateral rigidity of this arrangement is the result of alternatingly oppositely inclined leg poritons of the tie members which thereby act as tension and compression members, respectively, much like the bracing members of a truss.

The transverse rigidity of the sandwich panel tie members just described precludes their use for applications which, for reasons of thermal expansion or otherwise, require a limited transverse mobility of the supported panel layer relative to the supporting panel layer. The first-mentioned tie anchor, on the other hand, by providing such transverse mobility, fails to maintain a predetermined position of the supporting panel layer. Ideally, therefore, the outer concrete panel layer should be fixedly positioned relative to the supporting panel layer at one point only, that point being preferably the center of the panel area, while provision is made for minor relative displacements between the two concrete panel layers everywhere else on the panel.

SUMMARY OF THE INVENTION

It is a primary objective of the present invention to suggest an improved tie anchor for sandwich panels which fulfills the aforementioned requirements by providing a localized rigid connection between the concrete panel layers, while allowing for transverse displacements between the panel layers outside the rigid connection point.

The present invention proposes to attain this objective by suggesting a tie anchor of undulated zigzag outline, formed of a sheet metal strip, the tie anchor having a short length portion in which the undulations have oppositely inclined leg portions between their loop portions, and at least one additional length portion in which the leg portions of the undulations are substantially parallel to one another, so as to form a laterally displaceable parallel-linkage-type connection between the concrete panel layers.

By way of a preferred embodiment, the invention further suggests a one-piece tie anchor in the form of an undulated sheet metal strip which has in its center a V-shaped strip portion consisting of a loop and two oppositely inclined leg portions leading to two opposing loops to which are joined additional undulations with parallel leg portions. The several loops on each side of the tie anchor are embedded in the two concrete panel layers and firmly anchored therein by means of horizontal rods which extend through holes in the loop portions of the tie anchor and/or by means of vertical rods which bear against the insides of the loops.

The tie anchor is preferably so arranged between the layers of the sandwich panel that the V-shaped rigid center portion of the tie anchor is arranged near the panel center and that the yielding portions of the tie anchor extend horizontally in opposite directions from that center. This makes it possible to give the tie anchor any load carrying capacity desired, as the tie anchor can be of any desirable overall length, without sacrificing its novel characteristics of providing a panel support with a predetermined point of rigid attachment as well as a number of additional attachment points, where transverse displacements between the concrete panel layers can take place.

BRIEF DESCRIPTION OF THE DRAWINGS

Further special features and advantages of the invention will become apparent from the description following below, when taken together with the accompanying drawings which illustrate, by way of example, preferred embodiments of the invention which are represented in the various figures as follows:

FIG. 1 shows, in a prespective view, a tie anchor embodying the present invention;

FIG. 2 is a horizontal cross section through a portion of a sandwich panel incorporating therein the tie anchor of FIG. 1;

FIG. 5 is a frontal view of a sandwich panel, showing the general arrangement of the tie anchor of FIGS. 3 and 4.

DESCRIPTION OF THE PREFERRED EMBODIMENTS

Figure 3:
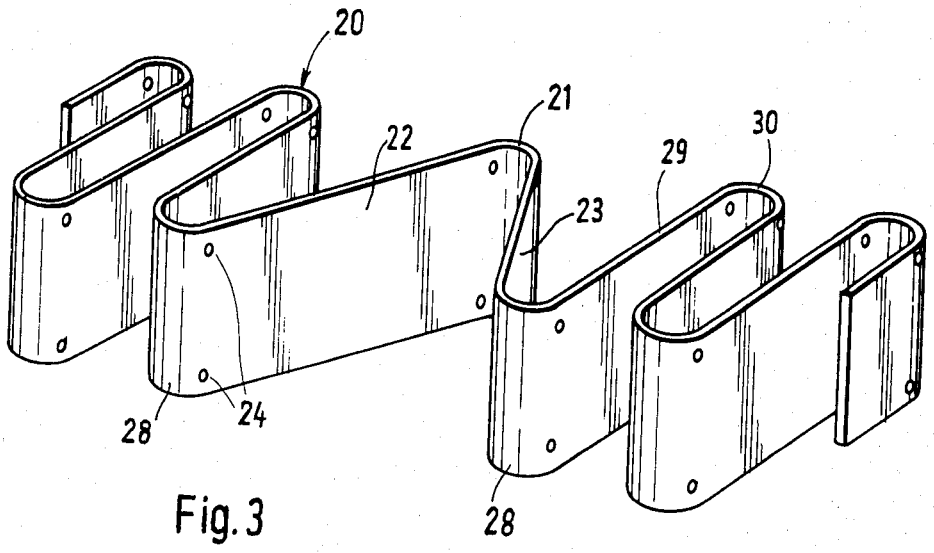
FIG. 3 shows, in a prespective view, a modified tie anchor embodying the present invention.

In FIGS. 1 and 2 of the drawing, there is shown a tie anchor 10 which has a generally V-shaped outline, consisting of a central loop portion 11 which is flanked by two oppositely inclined leg portions 12 and 13. The latter lead to opposing terminal loop portions 18 and 19. The central loop portion 11 and the terminal loop portions 18 and 19 have holes 14 extending transversely through them, the holes 14 being intended for the insertion of anchoring rods which position and attach the tie anchor in the concrete of the outer and inner layers 16 and 17 of the sandwich panel.

The panel layers 16 and 17 are reinforced concrete slabs. Between them is arranged an intermediate panel layer 15 of a light-weight insulating material. The latter may be mineral wool, foamed concrete, vermiculite, styrofoam, pumice concrete, slag concrete, or any comparable material. For certain applicantions, the tie anchor of FIGS. 1 and 2 can be further simplified by omitting the terminal loop portions 18 and 19, cutting the sheet metal strip at the stippled lines of FIG. 1, just outside the anchoring holes 14.

As can be seen in FIG. 2, the inclined leg portions 12 and 13 of the tie anchor 10 include between them an acute angle $\alpha$. It follows that the central point of attachment in the outer panel layer 16 and the two transversely spaced points of attachment in the inner panel layer 17 form a force triangle which creates a rigid connection between the panel layers 16 and 17, along the connection axis F. The inclined leg portions 12 and 13 thereby serve as diagonal braces, in a manner similar to that of the braces of a truss, holding the two panel layers in a laterally rigid relationship to one another, while also supporting the outer panel layer 16 on the inner panel layer 17.

The tie anchor of the present invention is preferably arranged in the center area of the sandwich panel, so that the panel layers are rigidly connected at or near the center of gravity. A limited displacement freedom between the two panel layers outside this rigid connection point accommodates unequal thermal expansion displacements of the two panels layers.

Figure 4:
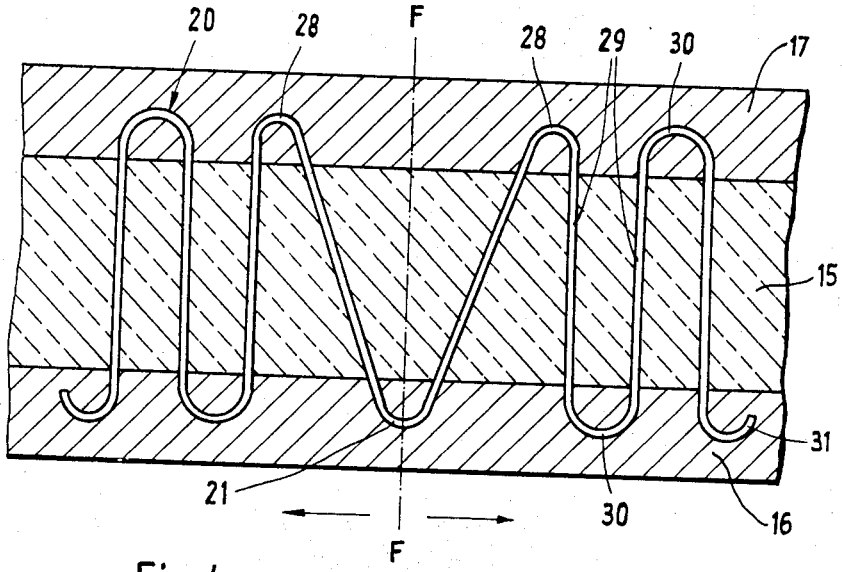
FIG. 4 is likewise a horizontal cross section through a sandwich panel incorporating therein the tie anchor of FIG. 3.

In FIGS. 3 and 4 of the drawing is shown a preferred embodiment of the invention which features an improved tie anchor for heavy sandwich panels, such as the one which is shown in FIG. 5. The proposed tie anchor 20, in addition to having a central V-shaped rigid anchor portion like the embodiment of FIGS. 1 and 2, has transversely yielding extensions on both sides of the rigid anchor portion. These yielding extensions consist of undulations formed by substantially parallel leg portions 29 and connecting loop portions 30, differing from the rigid center portion only in that the leg portions 22 and 23 of the latter are inclined in opposite directions. The loop portions 21 and 28 of the rigid anchor portion and the loop portions 30 of the adjoining yielding anchor portions are again attached to the panel layers 16 and 17 by means of anchoring rods (not shown) which extend through holes 24 in the loop portions.

The tie anchor 20 thus has all the advantages of the V-shaped tie anchor, which produces a rigid connection point, and it adds to it the load-supporting advantages of transversely yielding anchors which, because they are yielding, are not limited in their length and are therefore ideally suited for large panels (FIG. 5). The parallel leg portions 29 and their connecting loop portions 30 thereby act in the manner of parallel links, allowing for limited transverse displacements between the panel layers 16 and 17, as implied in FIG. 3 by the horizontal arrows which extend from the rigid connection point F. The vertical arrows indicate relative displaceability of the panel layers 16 and 17 above and below the central horizontal extent of the tie anchor. Because this novel tie anchor for sandwich panels is free of thermal stress conditions, it is advantageously usable for both light and heavy sandwich panel constructions.

It should be understood, of course, that the foregoing disclosure describes only preferred embodiments of the invention and that it is intended to cover all changes and modifications of these examples of the invention which fall within the scope of the appended claims.

We claim the following:

1. A tie anchor for sandwich panels and the like, particularly panels of the type which consist of inner and outer panel layers of concrete and an intermediate layer of an at least partially compressible thermally insulating material, the tie anchor comprising:

a continuous strip or band of steel which is shaped into a series of undulations defined by opposing loop portions and substantially straight leg portions connecting the loop portions, the spacing between the opposing loop portions being such that they alternatingly reach into the inner and outer panel layers; and means for anchoring the opposing loop portions in the concrete of the associated inner and outer panel layers; and wherein at least one centrally located leg portion is a diagonal leg portion which is oriented at an angle to a transverse plane that is perpendicular to the panels, thereby serving as a diagonal brace between itsadjoining loop portions in the inner and outer panel; and the other leg portions on both sides f the central diagonal leg portion, or portions, resectively, are oriented parallel to each other and to te transverse plane, thereby serving as parallel links which, by bending within the thickness of the compressble intermediate layer, are capable of accommodating longitudinal displacements of their embedded opposing loop portions which occur, when the inner and outer panels expand and contract unequally in response to temperature changes.

2. A tie anchor as defined in claim 1, wherein two leg portions which adjoin opposite ends of a central loop portion are diagonal leg portions, being so oriented that they form a V-shaped bracing structure.

3. A tie anchor as defined in claim 1 or claim 2, wherein the anchoring means includes aligned holes through at least some of the loop portions of the shaped strip, the holes being adapted for the insertion of anchoring rods.

4. A tie anchor as defined in claim 1 or claim 2, wherein the width of the steel strip is equal or greater than the thickness of the insulating layer of the sandwich panel.

* * * * *